US009491529B2

(12) United States Patent
Lee et al.

(10) Patent No.: US 9,491,529 B2
(45) Date of Patent: Nov. 8, 2016

(54) BUILT-IN AUDIO APPARATUS

(71) Applicant: SAMSUNG ELECTRONICS CO., LTD., Suwon-si (KR)

(72) Inventors: Seung-chan Lee, Seoul (KR); Ki-soo Kim, Gunpo-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 75 days.

(21) Appl. No.: 14/200,334

(22) Filed: Mar. 7, 2014

(65) Prior Publication Data

US 2014/0334628 A1 Nov. 13, 2014

(30) Foreign Application Priority Data

May 10, 2013 (KR) ..... 10-2013-0052913

(51) Int. Cl.

*H04R 29/00* (2006.01)
*H04R 1/00* (2006.01)
*H04R 1/02* (2006.01)

(52) U.S. Cl.

CPC ..... *H04R 1/00* (2013.01); *H04R 1/025* (2013.01); *H04R 2201/021* (2013.01)

(58) Field of Classification Search

CPC ... H04R 1/00; H04R 1/025; H04R 2201/021
USPC ..... 381/59
See application file for complete search history.

(56) References Cited

U.S. PATENT DOCUMENTS 6,741,720 B1 5/2004 Myatt
2003/0013503 A1* 1/2003 Menard ..... H04M 1/0291 455/569.2
2007/0253304 A1* 11/2007 Hsu ..... G11B 31/00 369/65
2008/0130938 A1 6/2008 Wan
2014/0094936 A1* 4/2014 Saunders ..... G05B 15/02 700/17

FOREIGN PATENT DOCUMENTS

DE 10 2006 015803 A1 10/2007
DE 20 2008 017374 U1 11/2009

(Continued)

OTHER PUBLICATIONS

BeoLab 15 & 16—Bang & Olufsen, "Hidden depths of sound", Internet article , http://www.bang-olufsen.com/en/sound/loudspeakers/beolab-15-16, total 6 pages, Retrieved from the Internet Aug. 2013.

(Continued)

*Primary Examiner* — Vivian Chin
*Assistant Examiner* — Ammar Hamid
(74) *Attorney, Agent, or Firm* — Sughrue Mion, PLLC

(57) ABSTRACT

A built-in audio apparatus includes a speaker unit, a mode setting unit configured to selectively set the speaker unit to one of a first position and a second position, and a controller configured to control the speaker unit depending on the setting of one of the first position and the second position. The mode setting unit is configured to be disposed in a surface of a structure, and includes an opening for emitting sound outputted from the speaker unit.

21 Claims, 9 Drawing Sheets

(56) References Cited

FOREIGN PATENT DOCUMENTS

| | | | |
|---|---|---|---|
| JP | 6-60922 | U | 8/1994 |
| JP | 2001-52558 | A | 2/2001 |
| JP | 2006-140669 | A | 6/2006 |
| JP | 4445882 | B2 | 4/2010 |
| JP | 2011-30170 | A | 2/2011 |
| KR | 10-0600890 | B1 | 7/2006 |
| WO | 2012062888 | A1 | 5/2012 |
| WO | WO 2012062888 | A1 * | 5/2012 ..... A47L 15/4293 |

OTHER PUBLICATIONS

Communication dated Apr. 10, 2014, issued by the European Patent Office in counterpart European Application No. 14153128.5.

Communication dated Sep. 22, 2016, issued by the European Patent Office in counterpart European Patent Application No. 14153128.5.

* cited by examiner

BUILT-IN AUDIO APPARATUS

CROSS-REFERENCE TO RELATED APPLICATION

This application claims priority from Korean Patent Application No. 2013-0052913 filed May 10, 2013 in the Korean Intellectual Property Office, the disclosure of which is incorporated herein by reference in its entirety.

BACKGROUND

1. Field

Apparatuses and methods consistent with exemplary embodiments relate to an audio apparatus, and more particularly, to an audio apparatus which is configured to be built-in a structure such as a wall.

2. Description of the Related Art

Speakers may be installed in a built-in state and may be used in various places such a variety of multimedia devices, vehicles, or walls of buildings.

Speakers installed in walls or ceilings inside a building usually are used for a floor broadcasting system. In this case, the speakers usually remain in a state fixed to the wall or ceiling, and audio signals are output from a separate broadcast device and transmitted to the speakers connected through wiring or wirelessly.

These built-in type of speakers are components that serve to output sound transmitted from, and are dependent on, the separate broadcast device (e.g. an audio apparatus that can play back audio data), and thus operations, such as the speakers themselves play back audio data, etc., are not possible.

SUMMARY

According to an aspect of an exemplary embodiment, there is provided a built-in audio apparatus including a speaker unit, a mode setting unit configured to selectively set the speaker unit to one of a first position and a second position, and a controller configured to control the speaker unit depending on the setting of one of the first position and the second position, wherein the mode setting unit is configured to be disposed in a surface of a structure, and includes an opening for emitting sound outputted from the speaker unit.

The speaker unit may be disposed inside the mode setting unit, and wherein the speaker unit maybe configured to move to the first position or the second position as the mode setting unit is rotated by a predetermined angle.

The mode setting unit may include a power switch configured to block power to the controller in the first position and apply power to the controller in the second position.

The opening may be concealed within the structure in the first position and exposed outside the structure in the second position.

The speaker unit may be a flat-type speaker.

The built-in audio apparatus may further include a volume adjusting unit that is disposed inside the mode setting unit, and is electrically connected to the controller in order to control a volume of the speaker unit.

The volume adjusting unit may include a touch sensor disposed on an inner surface of the mode setting unit.

The mode setting unit may further include a lighting unit including a lighting source that is disposed inside the mode setting unit and is electrically connected to the controller, and a window that is connected to the mode setting unit and is formed of a transparent or semitransparent material configured to radiate light emitted from the lighting source.

The lighting unit may further include a light guide plate that is disposed adjacent to the lighting source inside the mode setting unit, and is configured to guide the light emitted from the lighting source to the window.

The controller may be configured to drive the lighting source in the first position and the second position to emit light.

The controller may be electrically connected to a first communication unit, wherein the first communication unit may be configured to communicate with a second communication unit of a sound source providing unit storing audio data, wherein the sound source providing unit may be configured to transmit the audio data, using the second communication unit, to the first communication unit in response to a request by the controller, and wherein the controller may be configured to output the audio data received through the first communication unit using the speaker unit.

The first communication unit and the second communication unit may be configured to transmit wireless signals to and receive wireless signals from each other.

The mode setting unit may be formed in any one of a circular shape, an oval shape, and a polygonal shape.

The built-in audio apparatus may further include a separate speaker spaced at a distance from the built-in audio apparatus, wherein the controller is electrically connected to the separate speaker, and wherein the controller is configured to output sound through the separate speaker when the mode setting unit is in the second position.

According to an aspect of another exemplary embodiment, there is provided a built-in audio apparatus including a mode setting unit that is disposed in a surface of a structure and configured to selectively set a speaker unit arranged inside the mode setting unit in a first position or a second position, wherein the mode setting unit includes an opening for emitting sound outputted from the speaker unit outside the mode setting unit, a controller that is configured to only receive power in the second position and control the output of the speaker unit, a first communication unit electrically connected to the controller, and a sound source providing unit that includes a second communication unit configured to transmit and receive signals to and from the first communication unit, wherein the sound source providing unit is configured to store audio data, and transmit the audio data, via the second communication unit, to the first communication unit in response to a request from the controller, wherein the opening is concealed within the structure in the first position, and exposed outside the structure in the second position, and wherein the controller is further configured to output the audio data received through the first communication unit to the speaker unit.

The speaker unit may be a flat-type speaker.

The built-in audio apparatus may further include a touch sensor configured to adjust a volume of the speaker unit, wherein the touch sensor is disposed on an inner surface of the mode setting unit and is electrically connected to the controller.

The controller may be configured to be electrically connected to a lighting device inside a building, and wherein the controller may be configured to turn on or off the lighting device along with the speaker unit depending on whether the mode setting unit is in the first position or the second position, respectively.

The controller may be electrically connected to a separate speaker spaced at a distance from the built-in audio apparatus, and wherein the controller maybe configured to output sound through the separate speaker depending on whether the mode setting unit is in the second position.

BRIEF DESCRIPTION OF THE DRAWINGS

The above and/or other aspects will become apparent and more readily appreciated from the following description of exemplary embodiments, taken in conjunction with the accompanying drawings of which.

DETAILED DESCRIPTION OF THE EXEMPLARY EMBODIMENTS

Figure 1:
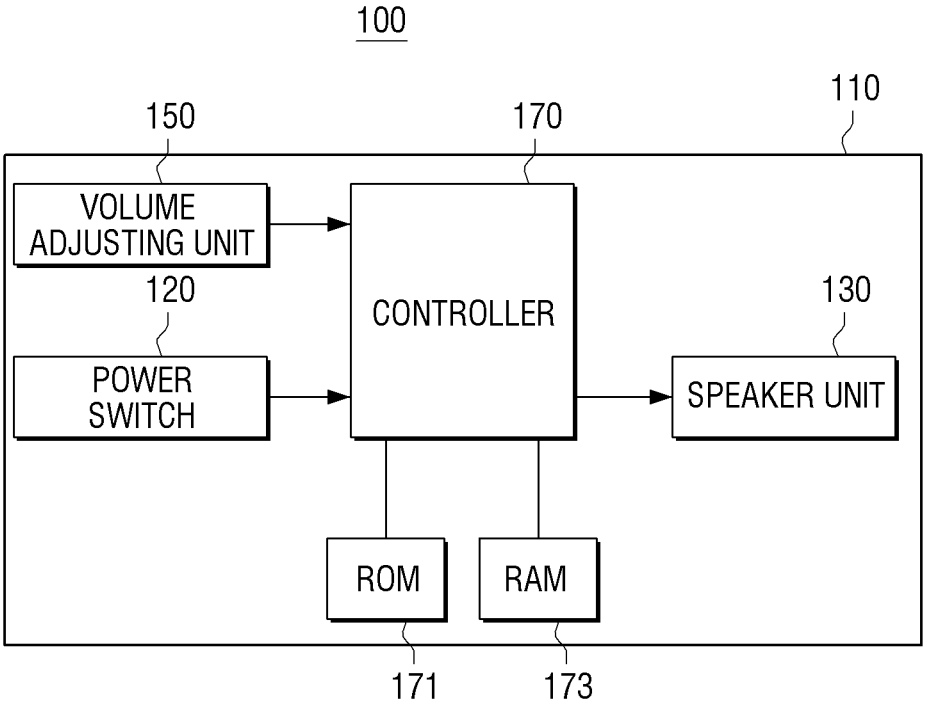
FIG. 1 is a block diagram illustrating a built-in audio apparatus according to an exemplary embodiment.

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding. Throughout the drawings, like reference numerals will be understood to refer to like parts, components and structures.

Referring to FIG. 1, a built-in audio apparatus 100 according to an exemplary embodiment may be installed so that a portion of the built-in audio apparatus 100 is buried in a structure, e.g., a wall of a building. In detail, the built-in audio apparatus 100 may be formed as a seesaw type of switch for turning on/off lighting. The built-in audio apparatus 100 includes a mode setting unit 110, a speaker unit 130, a volume adjusting unit 150, and a controller 170.

According to an exemplary embodiment, the built-in audio apparatus may be a wall mountable audio switch. Further, the wall mountable audio switch may include a rocker switch, which is also known as a decorator switch, or may at least have a similar shape to a rocker switch. Further the rocker switch shaped built-in audio apparatus may include a speaker within the rocker switch shaped portion along with also having a controller and a memory unit.

Figure 3:
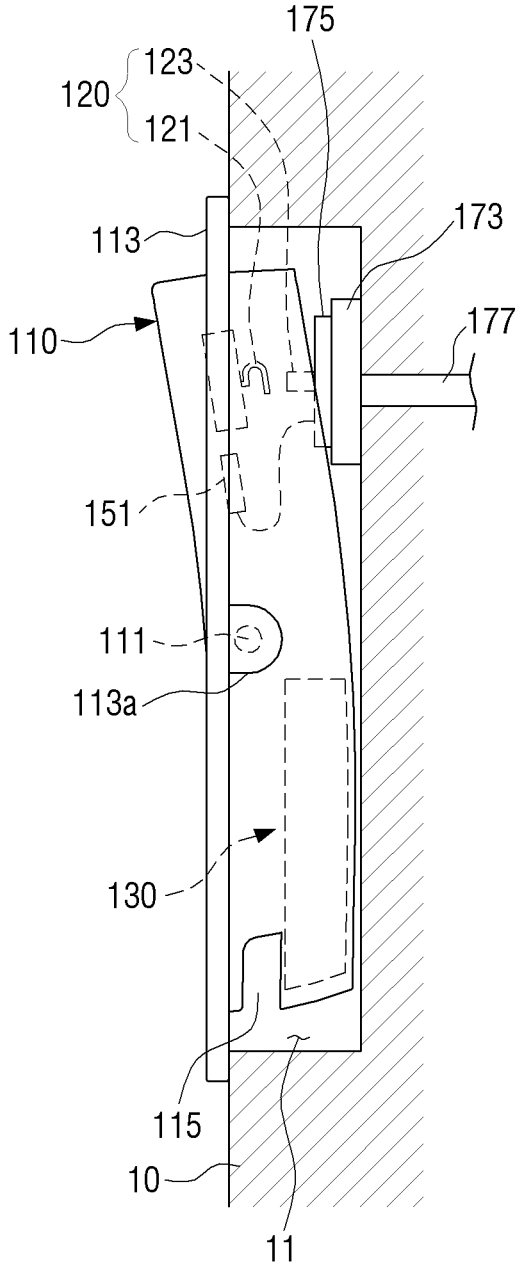
FIG. 3 is a sectional view along a line III-III as shown in FIG. 2 illustrating a built-in audio apparatus in an off state according to an exemplary embodiment.

Referring to FIG. 3, a rear portion of the mode setting unit 110 may be buried in a receiving groove 11 formed in the wall 10, and hinge protrusions 111 projecting from opposite sides of the mode setting unit 110 may be hinge-connected to a supporting frame 113.

The supporting frame 113 may be formed in a loop shape along a perimeter of the mode setting unit 110, and may be fixed to the wall 10. In this case, the inner circumferential surface of the supporting frame 113 and the outer circumferential surface of the mode setting unit 110 may be formed to maintain a predetermined gap so that when the mode setting unit 110 rotates on the hinge protrusions 111 in one direction or in the other direction, the supporting frame 113 does not interfere with the rotating operation of the mode setting unit 110.

The speaker unit 130 may be disposed inside the mode setting unit 110. The speaker unit 130 may be selectively set in a first (off) position (see FIG. 3) or a second (on) position (see FIG. 5) by the operation (a seesaw operation) of the mode setting unit 110 that rotates in one (upward or upper) direction or another (downward or lower) direction.

In each of a first and second positions, two kinds of operations may be carried out together. For example, in the first position, a power switch 120 may be spaced apart, and an opening 115 formed on a bottom surface of the mode setting unit 110 may be concealed inside the wall 10. In the second position, the power switch 120 may be connected so that power is applied to the controller, and the opening 115 of the mode setting unit 110 comes out from the wall 10 and is exposed to the outside of the wall 10.

Figure 4:
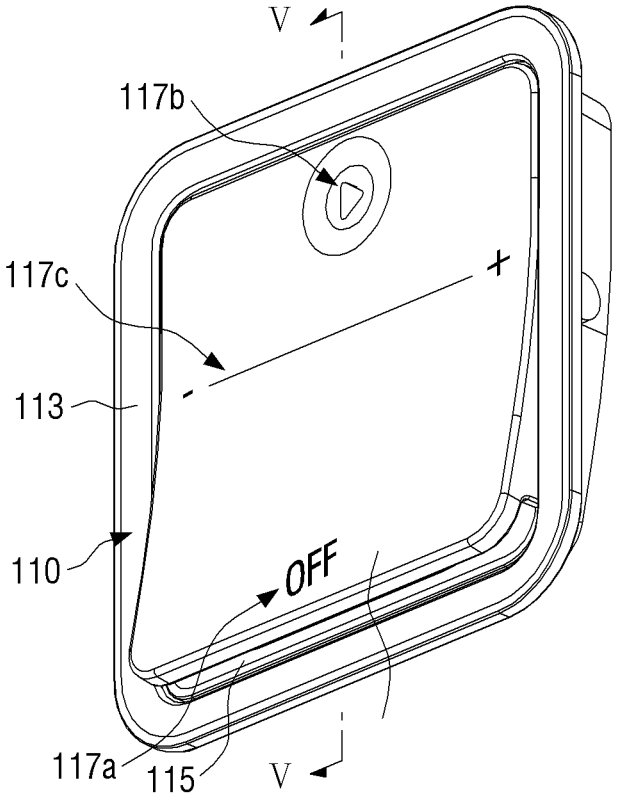
FIG. 4 is a perspective view illustrating a built-in audio apparatus in an on state according to an exemplary embodiment.

The mode setting unit 110 may be bent so that an upper portion and a lower portion of the mode setting unit 110 maintain a predetermined angle (e.g. an obtuse angle) between each other. Accordingly, in the first position, the upper portion of the mode setting unit 110 projects from the wall 10, and the lower portion of the mode setting unit 110 enters the receiving groove 11 of the wall 10, thereby becoming approximately level or flush with the wall 10 (see FIGS. 2 and 3). On the contrary, in the second position, the upper portion of the mode setting unit 110 enters the receiving groove 11 of the wall 10 so as to become approximately level or flush with the wall 10, and the lower portion of the mode setting unit 110 projects from the wall 10 (see FIGS. 4 and 5).

When the opening 115 is exposed outside the wall 10 in the second position, sound outputted from the speaker unit 130 may be emitted through the opening 115 of the mode setting unit 110. The opening 115 may be formed in a slit shape of a predetermined length along the bottom surface of the mode setting unit 110. In this case, a grill having a plurality of small holes may be disposed in the opening 115 in order to prevent foreign materials from entering the inside of the mode setting unit 110.

Figure 2:
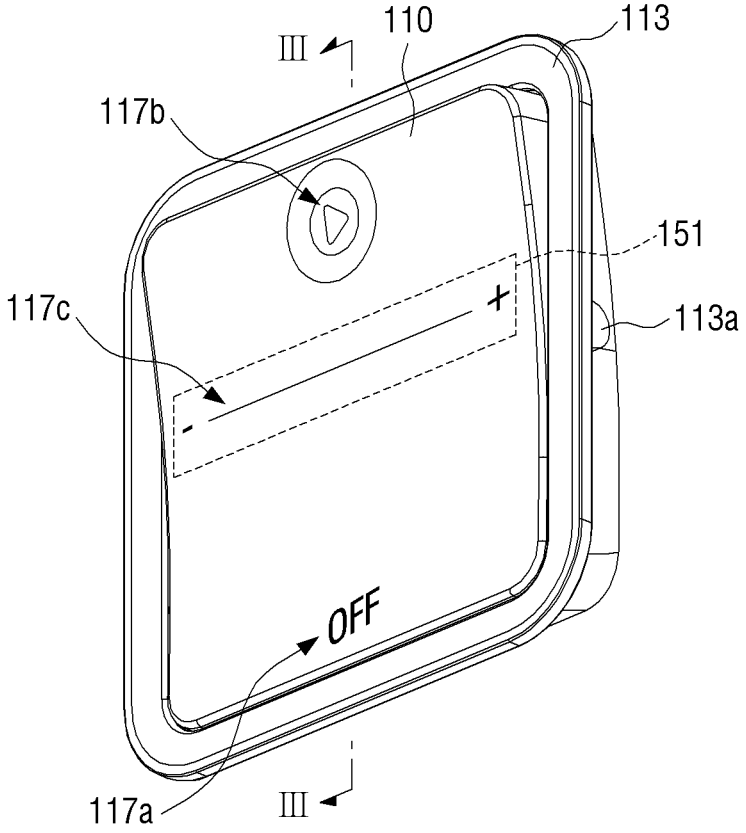
FIG. 2 is a perspective view illustrating a built-in audio apparatus in an off state according to an exemplary embodiment.

Referring to FIG. 2, first, second, and third marks 117*a*, 117*b*, and 117*c* may be formed at intervals on a front surface of the mode setting unit 110.

The first mark 117*a* may be positioned near a bottom end of the front surface of the mode setting unit 110, and may be formed as "OFF" of a character that means an off mode of the built-in audio apparatus 100 (in detail, in a state where the power switch 120 is spaced apart).

The second mark 117*b* may be positioned near a top end of the front surface of the mode setting unit 110, and may be formed as a figure that means an on mode of the built-in audio apparatus 100 (in detail, in a state where the power switch 120 is connected to and the speaker unit 130 outputs sound).

The third mark 117*c* may be positioned between the first mark 117*a* and the second mark 117*b*, and may be formed as a symbol or a figure that represents volume adjustment of the speaker unit 130. The third mark 117*c* includes a "–" symbol that means to reduce the volume on the left, a "+" symbol that means to increase the volume on the right, and a straight line between the "–" symbol and the "+" symbol. The third mark 117*c* is not limited to the above-mentioned configuration, and may be formed as a symbol, a figure, or a mixture of symbols and figures for an intuitive sign meaning that a user can adjust the volume of the speaker unit 130 by a touch and sliding method.

In an exemplary embodiment, the mode setting unit 110 may rotate in upper and lower directions. However, the rotating direction of the mode setting unit 110 is not limited thereto. It is also possible to configure that the mode setting unit 110 rotates in left and right directions according to another exemplary embodiment.

Figure 5:
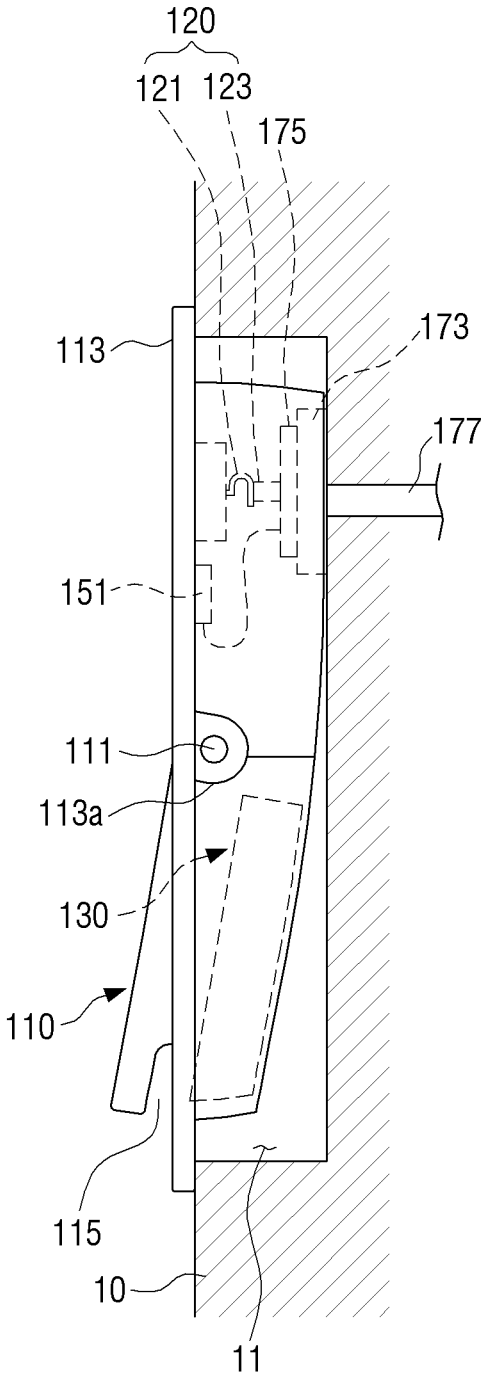
FIG. 5 is a sectional view along a line V-V as shown in FIG. 4 illustrating a built-in audio apparatus in an on state according to an exemplary embodiment.

Also, as shown in FIGS. 3 and 5, a portion of the power switch 120 may be arranged inside the upper portion of the mode setting unit 110. The power switch 120 includes a first terminal 121, and a second terminal 123 and a certain switching circuit which are disposed on a printed circuit board 175. In this case, the printed circuit board 175 may be fixed to a side surface of the receiving groove 11 facing an inner side surface of the mode setting unit 110. By the switching circuit, the first and second terminals 121 and 123 are spaced apart from each other in the first position to block the power being applied to the controller, and are in contact with each other in the second position to apply the power to the controller.

According to an exemplary embodiment, the mode setting unit 110 may be illustrated in the form of a square shape, but not limited thereto. The mode setting unit 110 may be formed in various shapes such as a polygonal shape, a circular shape, an oval shape, etc. In this case, regardless of the shape, the mode setting unit 110 may have a structure in which the seesaw motion can be performed.

The speaker unit 130 may be electrically connected to the controller 170, and is driven and off by the controller 170.

Figure 6:
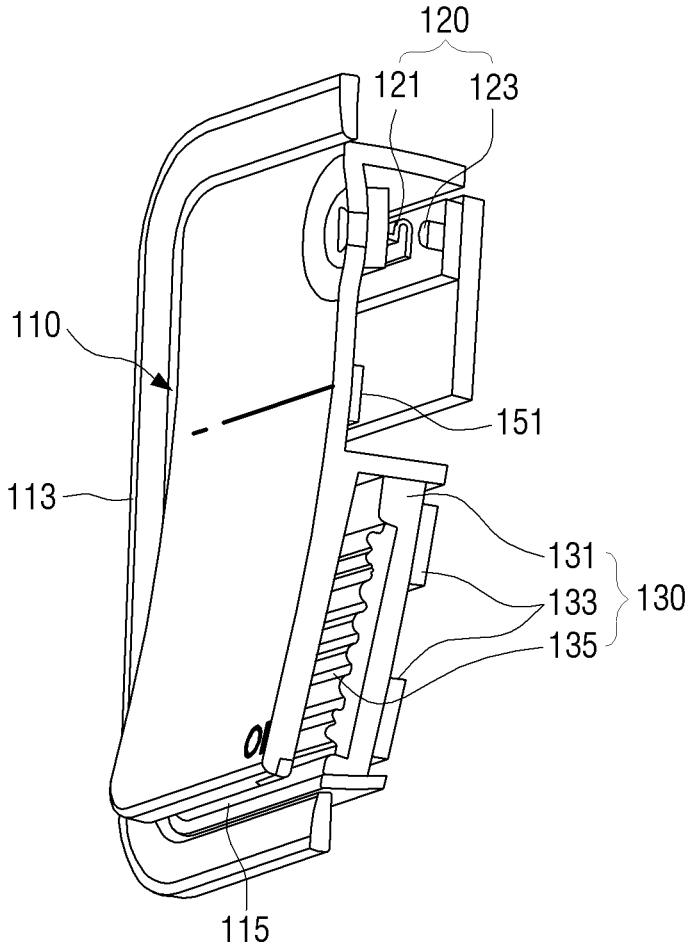
FIG. 6 is a perspective cutaway view along a line V-V as shown in FIG. 4 illustrating a built-in audio apparatus in an on state according to an exemplary embodiment.

Referring to FIG. 6, according to an exemplary embodiment, the speaker unit 130 may have a predetermined thickness capable of being inserted inside the lower portion of the mode setting unit 110, and is provided with a frame 131 equipped with an elastic damper and a transducer. The speaker unit 130 may include a magnet 133 disposed on one side of the frame 131 and a vibration plate 135 disposed on the other side of the frame 131. In this case, the transducer may be disposed on or inside the vibration plate 135, and makes bending waves to proceed inside the vibration plate 135 so that the vibration plate 135 is resonated, and then sound is emitted. The vibration plate 135 may be disposed to face the inner side surface of the mode setting unit 110 so that the sound is emitted through the opening 115 of the mode setting unit 110.

Also, the speaker unit 130 is not limited to the above-described configuration. The speaker unit 130 may be formed as a dynamic type of speaker of which a voice coil is formed in a flat plate and having a thin thickness.

Thus, any one of various known flat type of speakers may be applied to the speaker unit 130 according to one or more exemplary embodiments.

The volume adjusting unit 150 includes a touch sensor 151 which may be disposed on the inner side surface of the mode setting unit 110 and is electrically connected to the controller. The touch sensor 151 may be disposed at a position corresponding to the third mark 117*c*. In this case, the volume adjusting unit 150 receives a volume signal by a touch-and-drag method. For example, when the user touches his or her finger on the third mark 117*c* and drags along the straight line toward the "+" side or the"–" side, a volume adjusting signal is inputted into the touch sensor 151, and the inputted volume adjusting signal is transmitted from the touch sensor 151 to the controller 170. The controller 170 compares the received volume adjusting signal with preset values, and controls the speaker unit 130 with a volume corresponding to a corresponding volume value.

The controller 170 may be electrically connected to a ROM 171 (or EEPROM), in which certain programs (codec for encoding/decoding audio data, etc.) are stored, and a RAM 173 for storing data (e.g. audio data). The controller 170 plays back the audio data stored in the RAM 173 through the codec, and outputs it through the speaker unit 130.

Also, the controller 170 includes the printed circuit board 175 on which certain circuits (a power circuit, a switching circuit, an audio volume adjusting circuit, etc.) are formed. The printed circuit board 175 may be coupled to a power cable 177 connected to an external power source. When the power switch 120 is turned on (the second position), the printed circuit board 175 is supplied with the external power through the power cable 177. If the power is supplied to the printed circuit board 175, the controller 170 accesses the audio data stored in the RAM 173 by a predetermined program (if the audio data is compressed, the audio data may be processed by decoding), converts the audio data into analog signals, and outputs the analog signals to the speaker unit 130.

Furthermore, the controller 170 receives the volume adjusting signal through the touch sensor 151 of the volume adjusting unit 150, and controls the output of the speaker unit 130 with a corresponded volume value by comparing the volume adjusting signal with the pre-stored values.

Hereinafter, operation of the built-in audio apparatus 100 according to an exemplary embodiment configured as described above will be explained.

First, in the first position where the lower portion of the mode setting unit 110 is pressed and the upper portion of the mode setting unit 110 projects from the wall 10, because the first and second terminals 121 and 123 of the power switch 120 are spaced apart from each other, the power of the controller 170 is shut off so that the speaker unit 130 is not driven. In addition, the opening 115 of the mode setting unit 110 through which sound is outputted is concealed inside the wall 10.

On the contrary, in the second position where the upper portion of the mode setting unit 110 is pressed and the lower portion of the mode setting unit 110 projects from the wall 10, the first and second terminals 121 and 123 of the power switch 120 are interconnected so that the power is applied to the controller 170. At this time, the opening 115 of the mode setting unit 110 is exposed outside the wall 10 to emit the sound being outputted from the speaker unit 130.

Accordingly, the controller 170 accesses sound data stored in the RAM 173, converts the sound data into analog signals, and then outputs sound through the speaker unit 130. In this case, if a plurality of sound data is stored in the RAM 173, the sound data may be output in a preset playback order (random playback, sequential playback, etc.).

Figure 7:
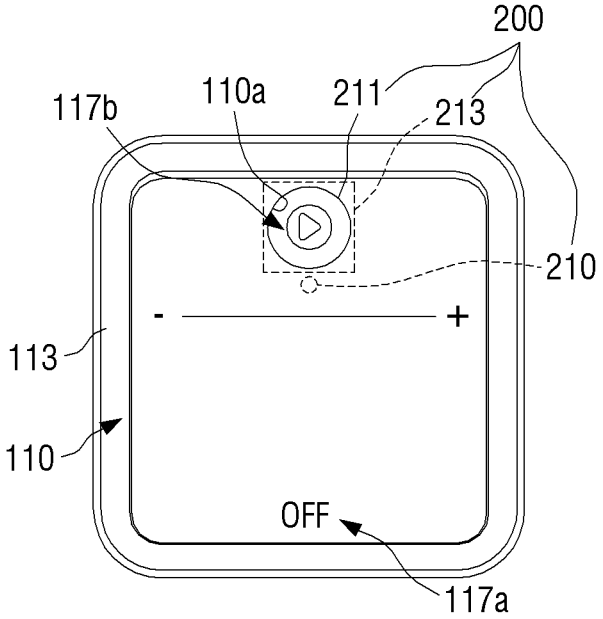
FIG. 7 is a front view illustrating first and second lighting units of a built-in audio apparatus according to an exemplary embodiment.

On the other hand, referring to FIG. 7, the built-in audio apparatus 100 according to an exemplary embodiment may further include a lighting unit 200 to tell the user whether audio is played back.

The lighting unit 200 may include a light source 210 disposed inside the mode setting unit 110, a window 211, and a light guide plate 213.

The light source 210 may be formed in a light emitting diode (LED) or a LED module including the LED. The light source 210 may be electrically connected to the controller 170, and is synchronized with the output of the speaker unit 130 by the controller 170. In other words, the light source 210 may be turned on while the audio data are being played back, and the light source 210 is turned off when the playback of the audio data is terminated. Moreover, the controller 170 may control the light source 210 to blink at predetermined intervals during playback of the audio data in addition to the simple on/off control.

The window 211 may be formed of a transparent or semitransparent material to radiate light emitted from the light source 210 outside the mode setting unit 110. In this case, the window 211 may be connected to a through hole 110*a* formed in a region corresponding to the second mark 117*b* of the mode setting unit 110. At this time, a figure representing a playback sign of the second mark 117*b* may be printed on the window 211.

The light guide plate 213 may be disposed inside the mode setting unit 110, and may be disposed at the same time adjacent to both the light source 210 and the window 211. The light emitted from the light source 210 may be transmitted through the light guide plate 213, and then may be effectively radiated through the window 211.

The same configuration as the lighting unit 200 may be applied to a region corresponding to the first mark 117*a* so that when the built-in audio apparatus 100 is in the first position, namely, when the built-in audio apparatus 100 is turned off, the region of the first mark 117*a* emits light to let the user know that the apparatus is an "off" state.

Figure 8:
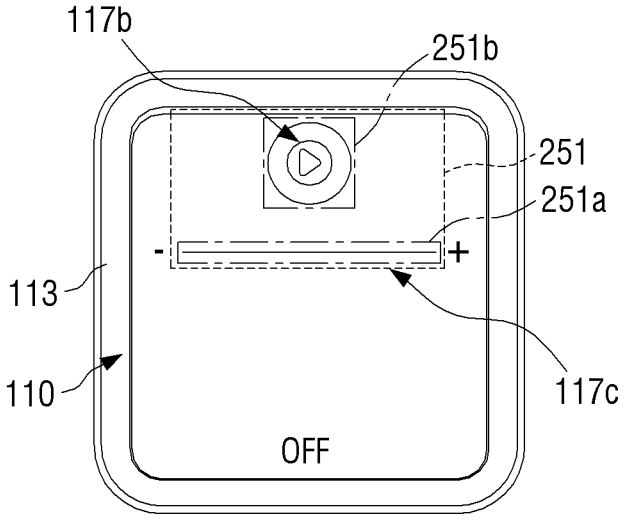
FIG. 8 is a front view illustrating a mode setting unit and a volume adjusting unit, which are implemented by a single touch sensor, of a built-in audio apparatus according to an exemplary embodiment.

Also, in the built-in audio apparatus 100 according to an exemplary embodiment, as illustrated in FIG. 2, the touch sensor 151 of the volume adjusting unit 150 may be formed to have an area corresponding to the region of the third mark 117*c*, but is not limited thereto. As illustrated in FIG. 8, a touch sensor 251 may be formed to have width and length to the extent that the second mark 117*b* and the third mark 117*c* are included.

In this case, the touch sensor 251 may set a first area 251*a* and a second area 251*b* corresponding to each of the third mark 117*c* and the second mark 117*b*. The first area 251*a* may be defined as a region for the function of the third mark 117*c*, for example, adjusting a volume of the sound outputted from the speaker unit 130 by the touch-and-drag method as described above. The second area 251*b* may be set as a region for the function of the second mark 117*b*, for example, playback of audio data by the touch method.

In this case, the second area 251*b* may be formed to implement a pause function by an additional touch in the playback mode or a function to select and playback next audio data when being touch-and-dragged left or right by the touch-and-drag method.

Figure 9:
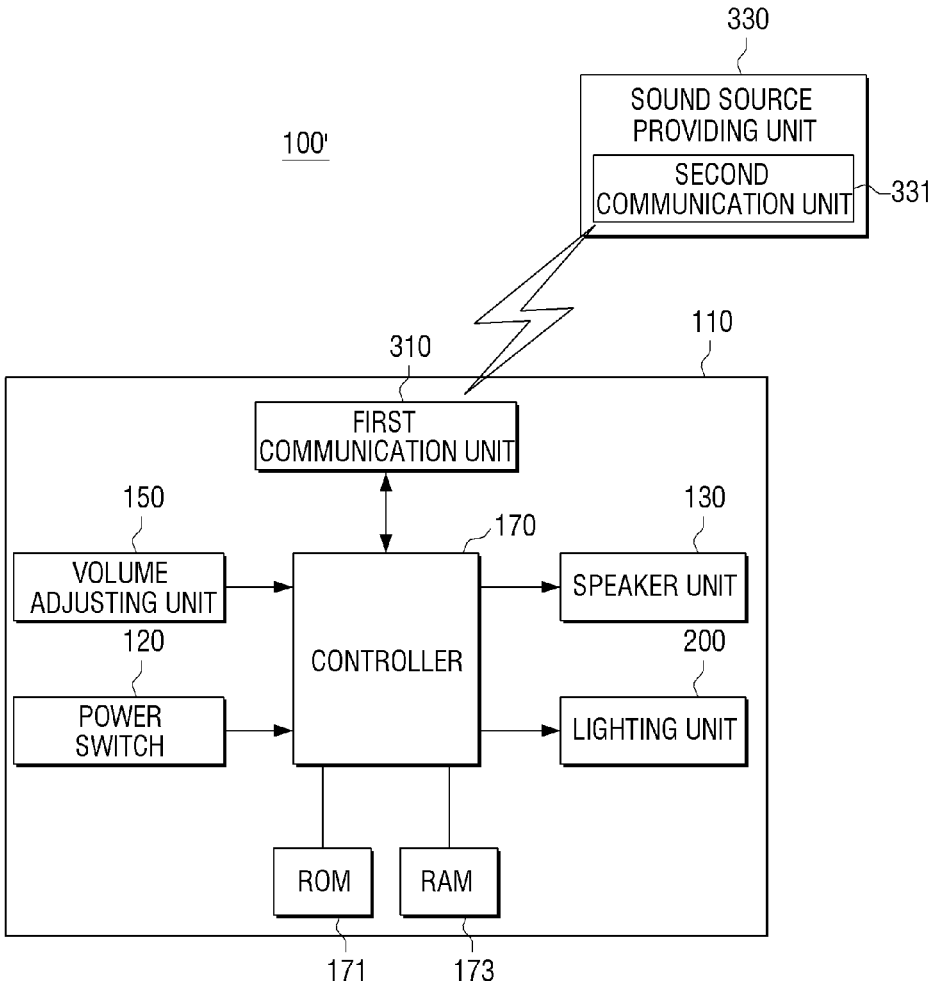
FIG. 9 is a block diagram illustrating a built-in audio apparatus according to another exemplary embodiment.

Referring to FIG. 9, a built-in audio apparatus 100' according to another exemplary embodiment is illustrated.

The built-in audio apparatus 100' according to another exemplary embodiment may receive audio data wirelessly from a separate sound source providing unit 330. In this case, a first communication unit 310 of the built-in audio apparatus 100' and a second communication unit 331 of the sound source providing unit 330 are communication modules which perform wireless communication with an external device located at close range, and may include, for example, Bluetooth, Zigbee, near field communication (NFC), etc. The first and second communication units 310 and 331 perform communication with each other according to a wireless communication protocol such as Wi-Fi, IEEE, etc. In addition, the first and second communication units 310 and 331 may perform communication by accessing the mobile communication network according to a variety of wide range mobile communication specifications such as third generation (3G), third generation partnership project (3GPP), long term evolution (LTE), etc.

Also, the built-in audio apparatus 100' according to another exemplary embodiment may output in real-time audio data provided from the sound source providing unit 330 by a real-time streaming protocol between the first and second communication units 310 and 331 through the speaker unit 130.

In this case, the first communication unit 310 is electrically connected to the controller 170, and may be disposed inside the mode setting unit 110 or in the receiving groove 11 of the wall 10. The controller 170 may store the audio data received from the first communication unit 310 in the RAM 173, or may temporarily store the audio data for buffering.

The sound source providing unit 330 may be made up of any one of mobile devices (e.g. smart phones, tablet computers, notebook computers, etc.), desktop PCs, and data servers connected through the internet.

In FIG. 9, a power switch 120, a volume adjusting unit 150, a ROM 171, and a lighting unit 200 are also disclosed in the exemplary embodiment. These components may be the same as the configuration of the built-in audio apparatus 100 according to an exemplary embodiment as described above; therefore, detailed explanations thereof will be omitted.

In the above description, the built-in audio apparatuses 100 and 100' according to according to one or more exemplary embodiments may operate independently of any other device, but are not limited thereto. The built-in audio apparatuses 100 and 100' may be configured to interact with various lighting devices or other audio devices that are installed in home.

For example, the controller 170 of the built-in audio apparatuses 100 and 100' of the present disclosure may be electrically connected to a power unit or ballast of a home lighting device through certain electric wires. In this case, when the mode setting unit 110 is set to the first position, the speaker unit 130 of the built-in audio apparatus becomes off, and the home lighting device is turned off together. On the contrary, when the mode setting unit 110 is set to the second position, the speaker unit 130 of the built-in audio apparatus becomes on, and the home lighting device is turned on together. As described above, the built-in audio apparatus according to the present disclosure may control the home lighting device together according to the on/off mode.

Also, the controller 170 of the built-in audio apparatus 100 of the present disclosure may be electrically connected to a separate audio device or a speaker equipped with the separate audio device through a certain electric wire. Similar to the above-described example, where the built-in audio apparatus is connected to the home lighting device, as the mode setting unit 110 of the built-in audio apparatus is set to the first position or the second position, the built-in audio apparatus may turn off or output sound through the separate audio device or the speaker. In this case, the built-in audio apparatus according to the present disclosure may omit the speaker unit 130 equipped with itself.

Also, if a third communication unit that can communicate with the first communication unit 310 is installed in a separate audio device, the built-in audio apparatus 100' according to the present disclosure equipped with the first communication unit 310 can control the separate audio device through the controller 170.

Moreover, the built-in audio apparatus according to the present disclosure may be electrically connected to both the home lighting device and the separate audio device at the same time. In this case, as the mode setting unit 110 of the built-in audio apparatus is set to the first position or the second position, the built-in audio apparatus may control at the same time the lighting and sound through the home lighting device and the separate audio device.

While the exemplary embodiments in the present disclosure have been described, additional variations and modifications of the exemplary embodiments may occur to those skilled in the art once they learn of the basic inventive concepts. Therefore, it is intended that the appended claims shall be construed to include both the above exemplary embodiments and all such variations and modifications that fall within the spirit and scope of the inventive concepts.

What is claimed is:

1. A built-in audio apparatus comprising:

a speaker unit;

a mode setting unit configured to selectively set the speaker unit to one of a first position and a second position; and a controller configured to control the speaker unit depending on the setting of one of the first position and the second position, wherein the mode setting unit is configured to be disposed in a surface of a structure, and comprises an opening through which sound outputted from the speaker unit is emitted, wherein the mode setting unit comprises a power switch configured to supply power to the controller to turn on the speaker unit in response to the mode setting unit changing from the first position to the second position.

2. The built-in audio apparatus of claim 1, wherein the speaker unit is disposed inside the mode setting unit, and wherein the speaker unit is configured to move to the first position or the second position as the mode setting unit is rotated by a predetermined angle.

3. The built-in audio apparatus of claim 1, wherein the opening is concealed within the structure in the first position and exposed outside the structure in the second position.

4. The built-in audio apparatus of claim 3, wherein the speaker unit is a flat-type speaker.

5. The built-in audio apparatus of claim 1, further comprising:

a volume adjusting unit that is disposed inside the mode setting unit, and is electrically connected to the controller in order to control a volume of the speaker unit.

6. The built-in audio apparatus of claim 5, wherein the volume adjusting unit comprises a touch sensor disposed on an inner surface of the mode setting unit.

7. The built-in audio apparatus of claim 1, wherein the mode setting unit further comprises a lighting unit comprising;

a lighting source that is disposed inside the mode setting unit and is electrically connected to the controller; and a window that is connected to the mode setting unit and is formed of a transparent or semitransparent material configured to radiate light emitted from the lighting source.

8. The built-in audio apparatus of claim 7, wherein the lighting unit further comprises a light guide plate that is disposed adjacent to the lighting source inside the mode setting unit, and is configured to guide the light emitted from the lighting source to the window.

9. The built-in audio apparatus of claim 7, wherein the controller is configured to drive the lighting source in the first position and the second position to emit light.

10. The built-in audio apparatus of claim 2, wherein the controller is electrically connected to a first communication unit, wherein the first communication unit is configured to communicate with a second communication unit of a sound source providing unit storing audio data, wherein the sound source providing unit is configured to transmit the audio data, using the second communication unit, to the first communication unit in response to a request by the controller, and wherein the controller is configured to output the audio data received through the first communication unit using the speaker unit.

11. The built-in audio apparatus of claim 10, wherein the first communication unit and the second communication unit are configured to transmit wireless signals to and receive wireless signals from each other.

12. The built-in audio apparatus of claim 1, wherein the mode setting unit is formed in any one of a circular shape, an oval shape, and a polygonal shape.

13. The built-in audio apparatus of claim 1, further comprising:

a separate speaker spaced at a distance from the built-in audio apparatus, wherein the controller is electrically connected to the separate speaker, and wherein the controller is configured to output sound through the separate speaker when the mode setting unit is in the second position.

14. A built-in audio apparatus comprising:

a mode setting unit that is disposed in a surface of a structure and configured to selectively set a speaker unit arranged inside the mode setting unit in a first position or a second position, wherein the mode setting unit comprises an opening for emitting sound outputted from the speaker unit outside the mode setting unit;

a controller that is configured to only receive power in the second position and control the output of the speaker unit;

a first communication unit electrically connected to the controller; and a sound source providing unit that comprises a second communication unit configured to transmit and receive signals to and from the first communication unit, wherein the sound source providing unit is configured to store audio data, and transmit the audio data, via the second communication unit, to the first communication unit in response to a request from the controller, wherein the opening is concealed within the structure in the first position, and exposed outside the structure in the second position, and wherein the controller is further configured to output the audio data received through the first communication unit to the speaker unit.

15. The built-in audio apparatus of claim 14, wherein the speaker unit is a flat-type speaker.

16. The built-in audio apparatus of claim 14, further comprising:

a touch sensor configured to adjust a volume of the speaker unit, wherein the touch sensor is disposed on an inner surface of the mode setting unit and is electrically connected to the controller.

17. The built-in audio apparatus of claim 1, wherein the controller is configured to be electrically connected to a lighting device inside a building, and wherein the controller is configured to turn on or off the lighting device along with the speaker unit depending on whether the mode setting unit is in the first position or the second position, respectively.

18. The built-in audio apparatus of claim 17, wherein the controller is electrically connected to a separate speaker spaced at a distance from the built-in audio apparatus, and wherein the controller is configured to output sound through the separate speaker depending on whether the mode setting unit is in the second position.

19. A wall mountable audio switch comprising:

a rocker switch configured to be actuated between an ON position and an OFF position;

a memory unit configured to store audio data;

a built-in speaker disposed within the rocker switch and configured to output the audio data; and a controller configured to control the built-in speaker to output the audio data from the memory unit based on the actuated ON position, wherein, when a position of the rocker switch changes from the OFF position to the ON position, one side of the rocker switch is raised to allow the built-in speaker to be exposed outside the wall mountable audio switch while another side of the rocker switch is depressed to supply power to the controller.

20. The built-in audio apparatus of claim 1, wherein:

when the mode setting unit in the first position, a lower portion of the mode setting unit is pressed down to conceal the speaker unit under the surface and an upper portion of the mode setting unit projects from the surface to space one terminal of a power switch apart from another terminal of the power switch that is connected to the controller.

21. The built-in audio apparatus of claim 1, wherein the speaker unit is concealed within the structure in the first position and exposed outside the structure in the second position through the opening.

* * * * *